US009905937B1

(12) United States Patent
Chiang

(10) Patent No.: US 9,905,937 B1
(45) Date of Patent: Feb. 27, 2018

(54) MULTI-INPUT MULTI-OUTPUT ANTENNA DEVICE

(71) Applicant: AUDEN TECHNO CORP., Taoyuan County (TW)

(72) Inventor: Chi-Ming Chiang, Taoyuan County (TW)

(73) Assignee: AUDEN TECHNO CORP., Taoyuan County (TW)

( * ) Notice: Subject to any disclaimer, the term of this patent is extended or adjusted under 35 U.S.C. 154(b) by 11 days.

(21) Appl. No.: 15/332,210

(22) Filed: Oct. 24, 2016

(51) Int. Cl.
*H01Q 1/48* (2006.01)
*H01Q 21/06* (2006.01)

(52) U.S. Cl.
CPC ..... *H01Q 21/065* (2013.01); *H01Q 1/48* (2013.01)

(58) Field of Classification Search
CPC ..... H01Q 21/065; H01Q 1/48
See application file for complete search history.

(56) References Cited

U.S. PATENT DOCUMENTS

2004/0095277 A1* 5/2004 Mohamadi ..... H01Q 1/38 343/700 MS
2004/0100405 A1* 5/2004 Mohamadi ..... H01Q 1/38 343/700 MS

* cited by examiner

*Primary Examiner* — Dameon E Levi
*Assistant Examiner* — David Lotter
(74) *Attorney, Agent, or Firm* — Li & Cai Intellectual Property (USA) Office

(57) ABSTRACT

A MIMO antenna device includes an antenna array, a grounding member, and several supporting pillars hanging the antenna array over the grounding member. The antenna array defining a first and a second longitudinal direction perpendicular to each other includes a square buffering sheet arranged at a center thereof, four square low-frequency antennas respectively arranged at four corners thereof, two square high-frequency antennas arranged at two opposite sides of the buffering sheet in the first longitudinal direction, and a first and a second feeding segment respectively connecting the two diagonal low-frequency antennas to the adjacent two high-frequency antennas. The antenna array can be provided to approximately construct into an inverted S-shaped circuit. Each side of the buffering sheet is different from an edge of each high-frequency antenna, and the edge of each high-frequency antenna is shorter than a side of each low-frequency antenna.

8 Claims, 7 Drawing Sheets

MULTI-INPUT MULTI-OUTPUT ANTENNA DEVICE

BACKGROUND OF THE INVENTION

1. Field of the Invention

The instant invention relates to an antenna device; in particular, to a multi-input multi-output (MIMO) antenna device.

2. Description of Related Art

The conventional single patch antenna has a maximum gain of 8 dBi, so a plurality of the conventional patch antennas must be combined to form an antenna array achieving a larger gain requirement (e.g., more than 8 dBi). However, the conventional antenna array is formed by collecting the conventional patch antennas, so the size of the conventional antenna array is too large, limiting the applied scope.

SUMMARY OF THE INVENTION

The instant disclosure provides a MIMO antenna device for effectively solving the problem generated from the conventional antenna array.

The instant disclosure provides a multi-input multi-output (MIMO) antenna device, comprising: an antenna array defining a first longitudinal direction and a second longitudinal direction perpendicular to the first longitudinal direction, the antenna array comprising: a buffering sheet having a substantially square shape and arranged at a center of the antenna array; a low-frequency unit having four low-frequency antennas and two first jumpers, wherein the four low-frequency antennas each having a substantially square shape are respectively arranged at four corners of the antenna array, wherein any two adjacent low-frequency antennas arranged in the first longitudinal direction are electrically connected by using one of the first jumpers, and the two first jumpers are arranged to face each other; a high-frequency unit having two first high-frequency antennas and two first extending segments, wherein the two first high-frequency antennas each having a substantially square shape are respectively arranged at two opposite sides of the buffering sheet, and the two first high-frequency antennas and the buffering sheet are arranged in the first longitudinal direction, wherein any two adjacent low-frequency antennas arranged in the second longitudinal direction are arranged with one of the first high-frequency antennas there-between, the buffering sheet and each of the first high-frequency antennas are electrically connected by using one of the first extending segments; wherein the length of an edge of the buffering sheet is different from that of an edge of each of the first high-frequency antennas, and the edge of each of the first high-frequency antennas is shorter than an edge of each of the low-frequency antennas; and a feeding unit having a first feeding segment and a second feeding segment, wherein two of the low-frequency antennas arranged in a diagonal of the antenna array are respectively and electrically connected to the adjacent first high-frequency antennas by using the first feeding segment and the second feeding segment; and a grounding member and a plurality of supporting pillars, wherein an end of each of the supporting pillars is fixed on the antenna array, and the other end of each of the supporting pillars is fixed on the grounding member, so that the antenna array is arranged apart from the grounding member.

In summary, when the MIMO antenna device of the instant disclosure receives two high-frequency signals through the first feeding segment and the second feeding segment, the first high-frequency antennas and the buffering sheet are shared to transmit the two high-frequency signals, thereby reducing the size of the MIMO antenna device.

Moreover, the length of the side of the buffering sheet is different from the length of the side of each of the first high-frequency antennas, so the resonance frequency of the buffering sheet does not overlap the high-frequency band, thereby improving the isolation between two signals, wherein the two signals are traveling along the two first high-frequency antennas and the buffering sheet in two opposing directions.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

Figure 1:
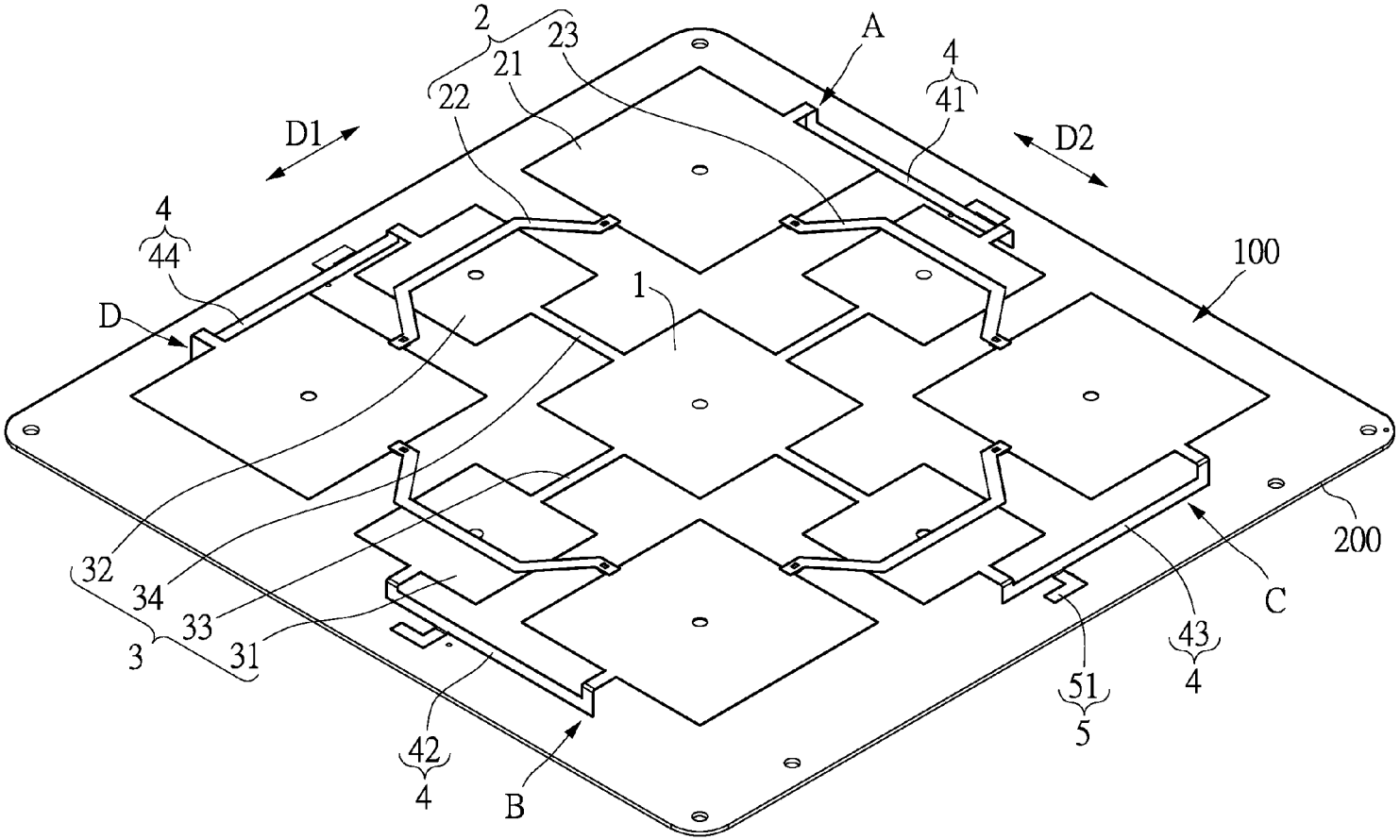
FIG. 1 is a perspective view showing a MIMO antenna device according to a first embodiment of the instant disclosure.
Figure 2:
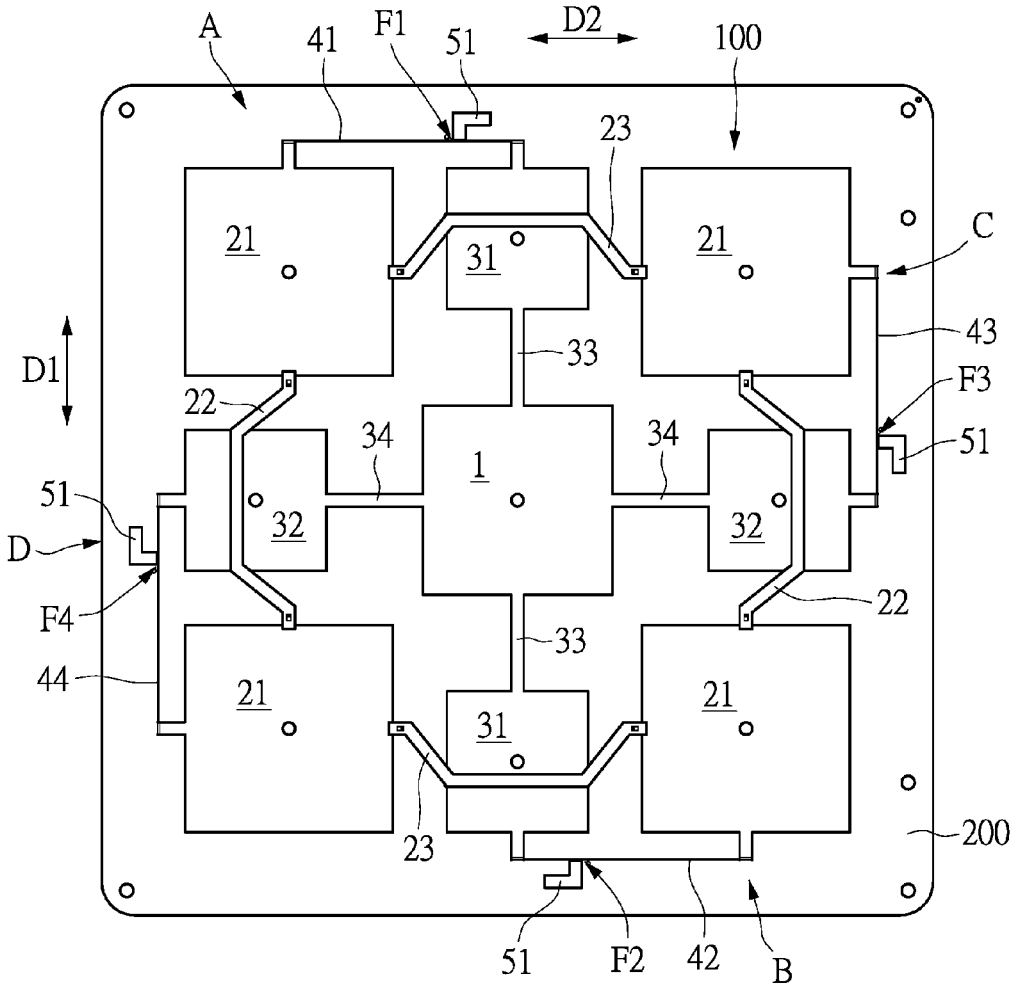
FIG. 2 is a top view of FIG. 1.
Figure 3:
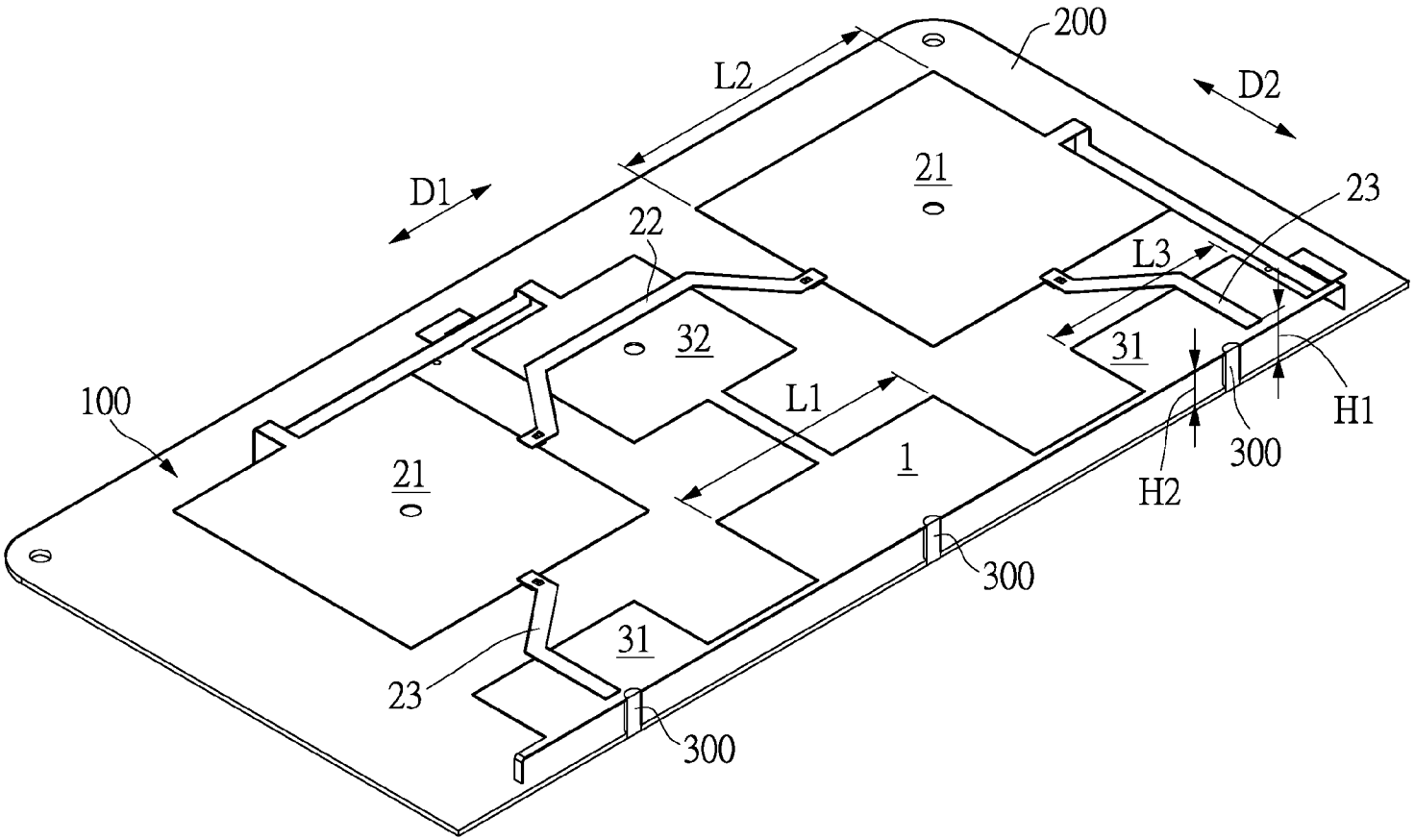
FIG. 3 is a cross-sectional view of FIG. 1.

Please refer to FIGS. 1 through 3, which show a MIMO antenna device including an antenna array 100, a grounding member 200, and a plurality of supporting pillars 300 (shown in FIG. 3). The grounding member 200 in the instant embodiment is a planar plate and has an area larger than that of the antenna array 100. An end of each of the supporting pillars 300 is fixed on the antenna array 100, and the other end of each of the supporting pillars 300 is fixed on the grounding member 200, so that the antenna array 100 is arranged apart from the grounding member 200.

It should be noted that "a substantially square shape" in the following description can be a square shape or a shape similar to a square shape. The following description discloses the construction of the antenna array 100, and then discloses the operation of the antenna array 100.

The outer contour of the antenna array 100 has a substantially square shape, and two adjacent edges of the substantially square shape of the antenna array 100 respectively define a first longitudinal direction D1 and a second longitudinal direction D2 perpendicular to the first longitudinal direction D1. The antenna array 100 includes a buffering sheet 1 having a substantially square shape and arranged at a center thereof, a low-frequency unit 2, a high-frequency unit 3, a feeding unit 4, and a matching unit 5. In the instant embodiment, the center of the buffering sheet 1 is the center of the antenna array 100, and the antenna array 100 is a four-folded symmetrical construction with respect to the center of the buffering sheet 1. The buffering sheet 1 and the high-frequency unit 3 are substantially in a coplanar arrangement, and a height H1 of the low-frequency unit 2 with respective to the grounding member 200 is more than a height H2 of the high-frequency unit 3 with respective to the grounding member 200.

The low-frequency unit 2 includes four low-frequency antennas 21 in a substantially coplanar arrangement and each having a substantially square shape, two first jumpers 22, and two second jumpers 23. The four low-frequency antennas 21 are respectively arranged at four corners of the antenna array 100, and each low-frequency antenna 21 does not shield the buffering sheet 1 in the height direction.

Any two adjacent low-frequency antennas 21 arranged in the first longitudinal direction D1 (i.e., the left two low-frequency antennas 21 or the right two low-frequency antennas 21 shown in FIG. 2) are electrically connected by using one of the first jumpers 22, and the two first jumpers 22 are arranged to face each other in the second longitudinal direction D2. Any two adjacent low-frequency antennas 21 arranged in the second longitudinal direction D2 (i.e., the upper two low-frequency antennas 21 or the lower two low-frequency antennas 21 shown in FIG. 2) are electrically connected by using one of the second jumpers 23, and the two second jumpers 23 are arranged to face each other in the first longitudinal direction D1.

Moreover, two adjacent edges of each of the low-frequency antennas 21 (e.g., the right edge and the lower edge of the upper left low-frequency antenna 21 shown in FIG. 2) each has a center, and the centers of the two adjacent edges of each of the low-frequency antennas 21 are respectively connected to the corresponding first jumper 22 and the corresponding second jumper 23.

The high-frequency unit 3 includes two first high-frequency antennas 31 each having a substantially square shape, two second high-frequency antennas 32 each having a substantially square shape, two elongated first extending segments 33, and two elongated second extending segments 34. The length of an edge of each of the first high-frequency antennas 31 is equal to that of an edge of each of the second high-frequency antennas 32.

The two first high-frequency antennas 31 are respectively arranged at two opposite sides (i.e., the upper side and the lower side) of the buffering sheet 1, and the two first high-frequency antennas 31 and the buffering sheet 1 are arranged in the first longitudinal direction D1. Any two adjacent low-frequency antennas 21 arranged in the second longitudinal direction D2 (i.e., the upper two low-frequency antennas 21 or the lower two low-frequency antennas 21 shown in FIG. 2) are arranged with one of the first high-frequency antennas 31 there-between, and the buffering sheet 1 and each of the first high-frequency antennas 31 are electrically connected by using one of the first extending segments 33. The center of the buffering sheet 1, the two first extending segments 33, and a center of each of the two first high-frequency antennas 31 are arranged in the first longitudinal direction D1. Specifically, ends of the two first extending segments 33 are respectively connected to the centers of two opposite edges (i.e., the upper side and the lower side) of the buffering sheet 1, and the other ends of the two first extending segments 33 are respectively connected to the centers of adjacent (and parallel) edges of the two first high-frequency antennas 31.

The two second high-frequency antennas 32 are respectively arranged at two opposite sides (i.e., the left side and the right side) of the buffering sheet 1, and the two second high-frequency antennas 32 and the buffering sheet 1 are arranged in the second longitudinal direction D2. Any two adjacent low-frequency antennas 21 arranged in the first longitudinal direction D1 (i.e., the left two low-frequency antennas 21 or the right two low-frequency antennas 21 shown in FIG. 2) are arranged with one of the second high-frequency antennas 32 there-between, and the buffering sheet 1 and each of the second high-frequency antennas 32 are electrically connected by using one of the second extending segments 34. The center of the buffering sheet 1, the two second extending segments 34, and a center of each of the two second high-frequency antennas 32 are arranged in the second longitudinal direction D2. Specifically, ends of the two second extending segments 34 are respectively connected to the centers of two opposite edges (i.e., the left side and the right side) of the buffering sheet 1, and the other ends of the two second extending segments 34 are respectively connected to the centers of adjacent (and parallel) edges of the two second high-frequency antennas 32.

Moreover, the length L3 of an edge of each of the first high-frequency antennas 31 is less than the length L2 of an edge of each of the low-frequency antennas 21, and the length L1 of an edge of the buffering sheet 1 is different from (e.g., more than) the length L3 of the edge of each of the first high-frequency antennas 31. Preferably, the length L1 of the edge of the buffering sheet 1 is less than the length L2 of the edge of each of the low-frequency antennas 21 and is more than the length L3 of the edge of each of the first high-frequency antennas 31.

Each of the low-frequency antennas 21 in the instant embodiment is configured to transmit a signal in a low-frequency band of 2300 MHz~2700 MHz. Each of the first high-frequency antennas 31 or the second high-frequency antennas 32 in the instant embodiment is configured to transmit a signal in a high-frequency band of 3400 MHz~3800 MHz.

When the low-frequency unit 2 and the high-frequency unit 3 are orthogonally projected onto the grounding member 200 (as shown in FIG. 2), the outer edge of any two of the low-frequency antennas 21 arranged in the first longitudinal direction D1 (e.g., the left edges of the left two low-frequency antennas 21) and the outer edge of the adjacent second high-frequency antenna 32 (i.e., the left edge of the left second high-frequency antenna 32) are aligned with each other and are arranged in a collinear arrangement, the outer edge of any two of the low-frequency antennas 21 (e.g., the upper edges of the upper two low-frequency antennas 21) arranged in the second longitudinal direction D2 and the outer edge of the adjacent first high-frequency antenna 31 (e.g., the upper edge of the upper first high-frequency antenna 31) are aligned with each other and are arranged in a collinear arrangement.

Moreover, as shown in FIG. 2, a first projecting region (not labeled) defined by orthogonally projecting each of the first jumpers 22 onto the adjacent second high-frequency antenna 32 is arranged apart from the center of the adjacent second high-frequency antenna 32 and is arranged away from the buffering sheet 1, thus the above arrangement of each first jumper 22 can effectively avoid influencing the adjacent second high-frequency antenna 32. A second projecting region (not labeled) defined by orthogonally projecting each of the second jumpers 23 onto the adjacent first high-frequency antenna 31 is arranged apart from the center of the adjacent first high-frequency antenna 31 and is arranged away from the buffering sheet 1, thus the above arrangement of each second jumper 23 can effectively avoid influencing the adjacent first high-frequency antenna 31.

The feeding unit 4 includes four separated segments, which are named as a first feeding segment 41, a second feeding segment 42, a third feeding segment 43, and a fourth feeding segment 44. Two of the low-frequency antennas 21 arranged in a diagonal of the antenna array 100 (i.e., the upper left low-frequency antenna 21 and the lower right low-frequency antenna 21 shown in FIG. 2) are respectively and electrically connected to the adjacent first high-frequency antennas 31 by using the first feeding segment 41 and the second feeding segment 42. The other two low-frequency antennas 21 arranged in the other diagonal of the antenna array 100 (i.e., the upper right low-frequency antenna 21 and the lower left low-frequency antenna 21 shown in FIG. 2) are respectively and electrically connected to the adjacent second high-frequency antennas 32 by using the third feeding segment 43 and the fourth feeding segment 44.

Moreover, each of the first feeding segment 41, the second feeding segment 42, the third feeding segment 43, and the fourth feeding segment 44 in the instant embodiment has a substantially U-shape and is partially bent to the grounding member 200 for setting a signal feeding point F1, F2, F3, F4. The position of the signal feeding points F1, F2, F3, F4 can be adjusted according to the designer's demand.

The matching unit 5 in the instant embodiment includes four L-shaped matching segments 51 respectively connected to the first feeding segment 41, the second feeding segment 42, the third feeding segment 43, and the fourth feeding segment 44 for providing a matching adjustment to the feeding unit 4. In addition, the instant disclosure can provide the matching adjustment by using a circuit board (not shown), changing the distance between the feeding unit 4 and the grounding member 200, or changing the width of at least one of the first feeding segment 41, the second feeding segment 42, the third feeding segment 43, and the fourth feeding segment 44.

Specifically, the first feeding segment 41, the second feeding segment 42, the third feeding segment 43, and the fourth feeding segment 44 of the antenna array 100 can be operated at the same time for receiving a plurality of signals, so the following description sequentially discloses a first operating mode of the MIMO antenna device and a second operating mode of the MIMO antenna device, thereby clearly explaining the operation of the MIMO antenna device. When in the first operating mode, the necessary elements of the antenna array 100 are shown in FIG. 4, and when in the second operating mode, the necessary elements of the antenna array 100 are shown in FIG. 5.

[First Operating Mode]

Figure 4:
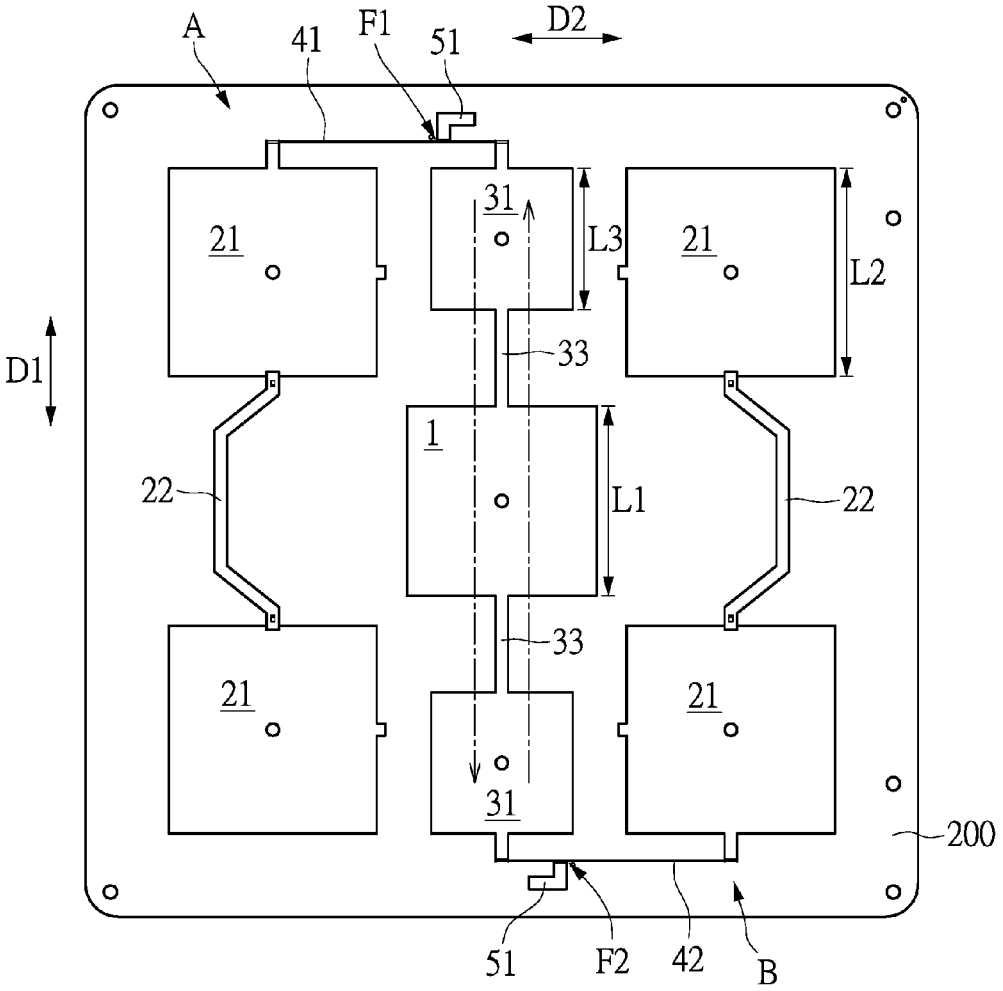
FIG. 4 is a top view of FIG. 1 showing part of the antenna array corresponding to a first operating mode.
Figure 5:
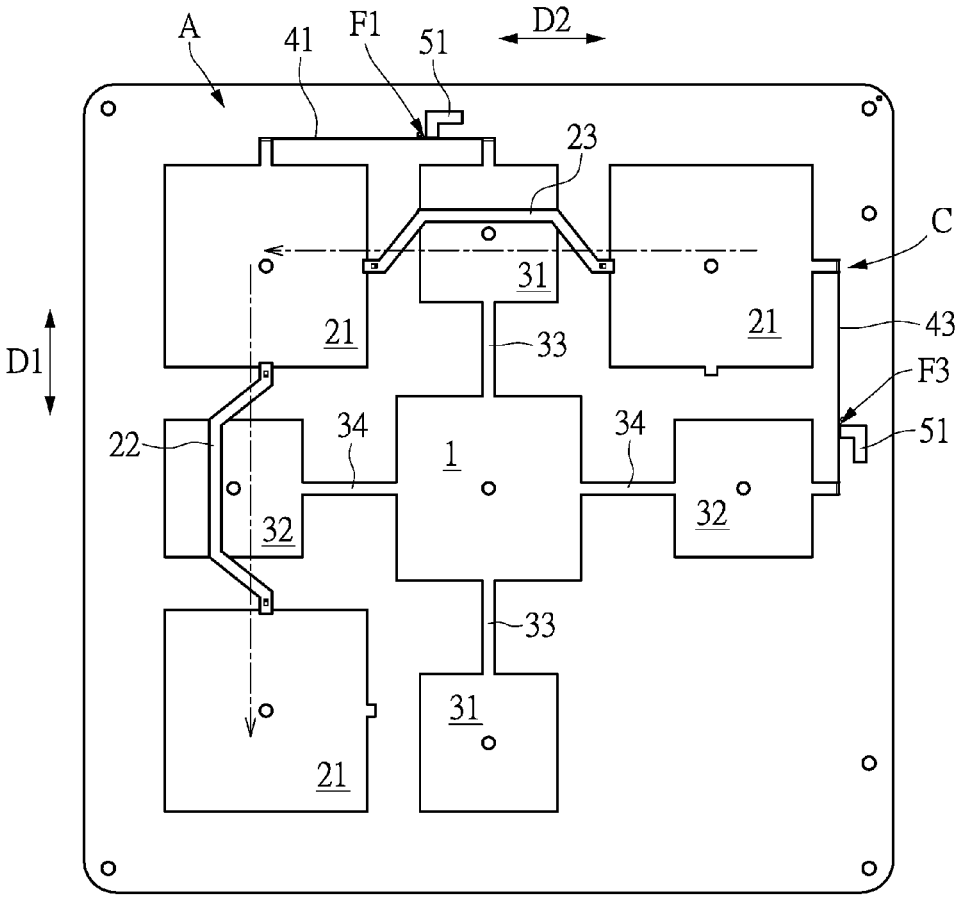
FIG. 5 is a top view of FIG. 1 showing part of the antenna array corresponding to a second operating mode.

As shown in FIG. 4, a first dual-frequency patch antenna A includes the first feeding segment 41 and the connected matching segment 51, the left two low-frequency antennas 21 and the connected first jumper 22 arranged in the first longitudinal direction D1, the two first high-frequency antennas 31, the two first extending segments 33, and the buffering sheet 1. A second dual-frequency patch antenna B includes the second feeding segment 42 and the connected matching segment 51, the right two low-frequency antennas 21 and the connected first jumper 22 arranged in the first longitudinal direction D1, the two first high-frequency antennas 31, the two first extending segments 33, and the buffering sheet 1.

Figure 6:
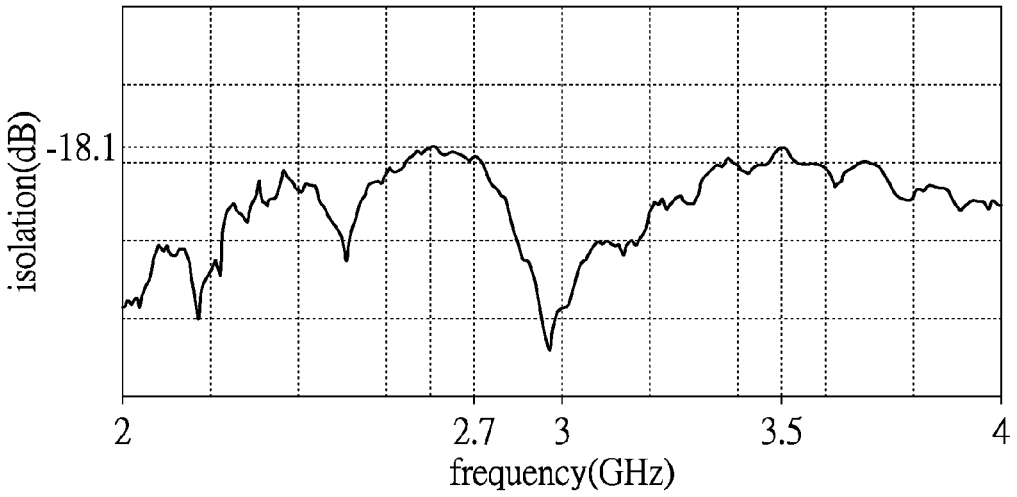
FIG. 6 is a simulating diagram showing the isolation of the MIMO antenna device in the first operating mode.

Accordingly, each of the first dual-frequency patch antenna A and the second dual-frequency patch antenna B is operated by using the two first high-frequency antennas 31, the two first extending segments 33, and the buffering sheet 1 to transmit a high-frequency signal, so the size of the antenna array 100 can be reduced. Moreover, in order to increase the isolation between the first dual-frequency patch antenna A and the second dual-frequency patch antenna B operated in the high-frequency band, the length L1 of the side of the buffering sheet 1 is different from the length L3 of the side of each of the first high-frequency antennas 31, such that a resonance frequency of the buffering sheet 1 does not overlap the high-frequency band corresponding to each first high-frequency antenna 31. Thus, two signals, which are respectively feeding from the first feeding segment 41 and the second feeding segment 42 and traveling along the two first high-frequency antennas 31 and the buffering sheet 1 in two opposing directions (i.e., two dashed arrows as shown in FIG. 4), have an isolation smaller than −15 dB (i.e., the isolation of the instant embodiment as shown in FIG. 6 can be smaller than −18 dB).

Similarly, as shown in FIG. 2, a third dual-frequency patch antenna C includes the third feeding segment 43 and the connected matching segment 51, the upper two low-frequency antennas 21 and the connected second jumper 23 arranged in the second longitudinal direction D2, the two second high-frequency antennas 32, the two second extending segments 34, and the buffering sheet 1. A fourth dual-frequency patch antenna D includes the fourth feeding segment 44 and the connected matching segment 51, the lower two low-frequency antennas 21 and the connected second jumper 23 arranged in the second longitudinal direction D2, the two second high-frequency antennas 32, the two second extending segments 34, and the buffering sheet 1.

Accordingly, each of the third dual-frequency patch antenna C and the fourth dual-frequency patch antenna D is operated by using the two second high-frequency antennas 32, the two second extending segments 34, and the buffering sheet 1 to transmit a high-frequency signal, so the size of the antenna array 100 can be reduced. Moreover, in order to increase the isolation between the third dual-frequency patch antenna C and the fourth dual-frequency patch antenna D operated in the high-frequency band, the length L1 of the side of the buffering sheet 1 is different from the length of the side of each of the second high-frequency antennas 32, such that the resonance frequency of the buffering sheet 1 does not overlap the high-frequency band corresponding to each second high-frequency antenna 32. Thus, two signals, which are respectively feeding from the third feeding segment 43 and the fourth feeding segment 44 and traveling along the two second high-frequency antennas 32 and the buffering sheet 1 in two opposing directions, have an isolation smaller than −15 dB (i.e., the isolation of the instant embodiment can be smaller than −18 dB).

[Second Operating Mode]

Please refer to FIG. 5, which shows the first dual-frequency patch antenna and the third dual-frequency patch antenna C. The upper left low-frequency antenna 21 and the buffering sheet 1 are shared for the first dual-frequency patch antenna and the third dual-frequency patch antenna C. The shared low-frequency antenna 21 uses the center of the lower edge and center of the right edge to respectively connect to the corresponding first jumper 22 and the corresponding second jumper 23, so a cross-section of the shared low-frequency antenna 21 along the center of the lower edge or the center of the right edge has an electric field of zero. Thus, when the first dual-frequency patch antenna A and the third dual-frequency patch antenna C are operated in the low-frequency band, the other two low-frequency antennas 21 of the first dual-frequency patch antenna A and the third dual-frequency patch antenna C do not influence each other by using the shared low-frequency antenna 21.

Moreover, ends of the two first extending segments 33 are respectively connected to the centers of two opposite edges of the buffering sheet 1, and the other ends of the two first extending segments 33 are respectively connected to the centers of adjacent (and parallel) edges of the two first high-frequency antennas 31; ends of the two second extending segments 34 are respectively connected to the centers of the other two opposite edges of the buffering sheet 1, and the other ends of the two second extending segments 34 are respectively connected to the centers of adjacent (and parallel) edges of the two second high-frequency antennas 32. Accordingly, a cross-section of the shared buffering sheet 1 along the center of any two opposite edges has an electric field of zero, and the resonance frequency of the buffering sheet 1 does not overlap the high-frequency band, so when the first dual-frequency patch antenna A and the third dual-frequency patch antenna C are operated in the high-frequency band, the first high-frequency antennas 31 and the second high-frequency antennas 32 do not influence each other by using the shared buffering sheet 1.

Similarly, the other operating modes of the first dual-frequency patch antenna A, the second dual-frequency patch antenna B, the third dual-frequency patch antenna C, and the fourth dual-frequency patch antenna D are similar to at least one of the first operating mode and the second operating mode, so the instant embodiment does not describe it further. Moreover, when the MIMO antenna device is operated in the high-frequency band and the low-frequency band, the gains of each of the first dual-frequency patch antenna A, the second dual-frequency patch antenna B, the third dual-frequency patch antenna C, and the fourth dual-frequency patch antenna D are shown in the following chart.

| Frequency (MHz) | 2300 | 2350 | 2400 | 2450 | 2500 | 2550 | 2600 | 2650 | 2700 |
|---|---|---|---|---|---|---|---|---|---|
| A(dBi) | 10.45 | 11.21 | 10.94 | 10.38 | 10.05 | 10.54 | 10.81 | 10.12 | 9.94 |
| B(dBi) | 10.63 | 11.11 | 11.03 | 10.74 | 9.94 | 10.59 | 11.07 | 10.54 | 9.89 |
| C(dBi) | 11.15 | 10.17 | 9.83 | 10.78 | 10.34 | 10.28 | 10.28 | 9.72 | 9.33 |
| D(dBi) | 10.53 | 11.13 | 10.40 | 9.86 | 9.88 | 10.61 | 11.06 | 10.77 | 10.60 |

| Frequency (MHz) | 3400 | 3450 | 3500 | 3550 | 3600 | 3650 | 3700 | 3750 | 3800 |
|---|---|---|---|---|---|---|---|---|---|
| A(dBi) | 8.76 | 9.62 | 10.84 | 10.05 | 8.80 | 8.43 | 9.12 | 8.97 | 9.02 |
| B(dBi) | 9.21 | 9.57 | 10.87 | 10.51 | 8.59 | 8.22 | 9.92 | 9.83 | 9.52 |
| C(dBi) | 9.65 | 10.10 | 10.21 | 9.16 | 9.02 | 9.56 | 10.26 | 10.22 | 8.71 |
| D(dBi) | 9.11 | 10.29 | 10.88 | 9.91 | 8.89 | 9.13 | 9.45 | 9.68 | 9.81 |

Figure 7:
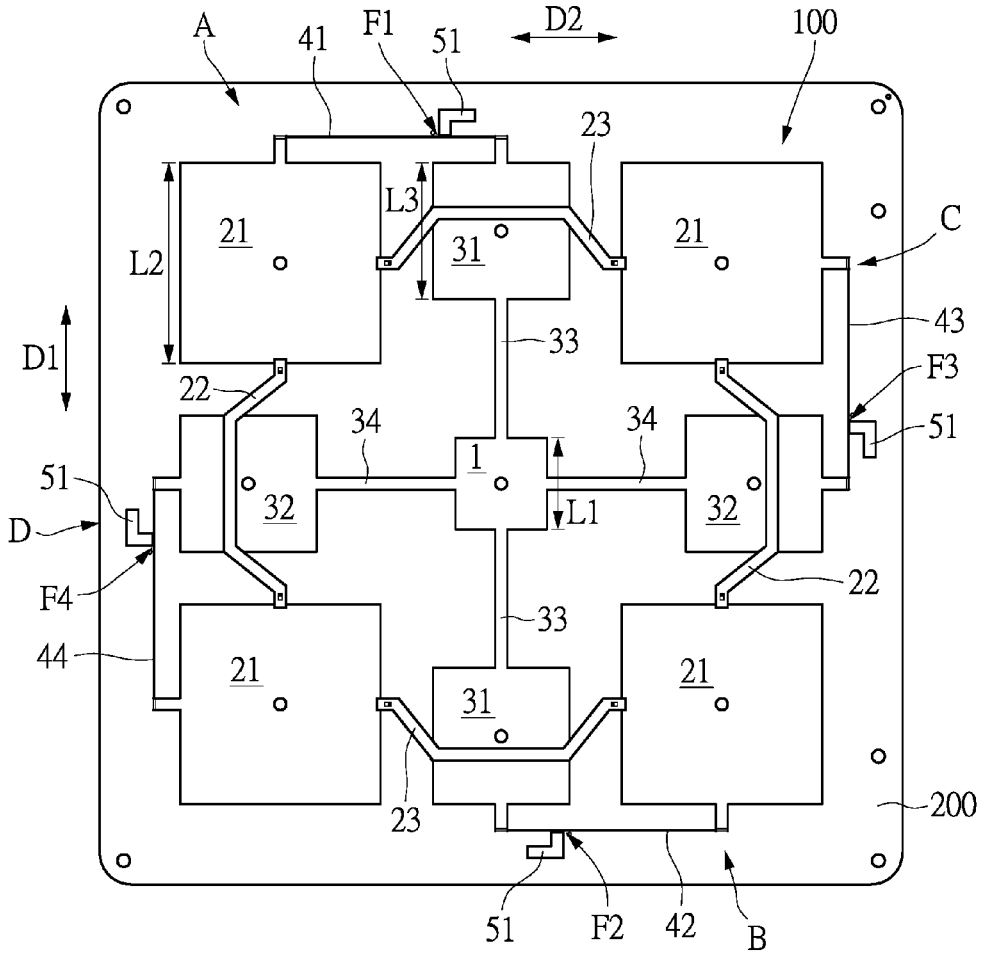
FIG. 7 is a planar view showing the MIMO antenna device according to a second embodiment of the instant disclosure.

In addition, the antenna array 100 in the instant embodiment takes FIG. 2 for example, but in practical use, the antenna array 100 can be formed as shown in FIG. 4. Moreover, please refer to FIG. 7, which shows a second embodiment of the instant disclosure. Specifically, the length L1 of the side of the buffering sheet 1 can be less than the length L3 of the side of each of the first high-frequency antennas 31, and the isolation of the antenna array 100 of the second embodiment is still better than the conventional antenna array.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. A multi-input multi-output (MIMO) antenna device, comprising:

an antenna array defining a first longitudinal direction and a second longitudinal direction perpendicular to the first longitudinal direction, the antenna array comprising:

a buffering sheet having a substantially square shape and arranged at a center of the antenna array;

a low-frequency unit having four low-frequency antennas and two first jumpers, wherein the four low-frequency antennas each having a substantially square shape are respectively arranged at four corners of the antenna array, wherein any two adjacent low-frequency antennas arranged in the first longitudinal direction are electrically connected by using one of the first jumpers, and the two first jumpers are arranged to face each other;

a high-frequency unit having two first high-frequency antennas and two first extending segments, wherein the two first high-frequency antennas each having a substantially square shape are respectively arranged at two opposite sides of the buffering sheet, and the two first high-frequency antennas and the buffering sheet are arranged in the first longitudinal direction, wherein any two adjacent low-frequency antennas arranged in the second longitudinal direction are arranged with one of the first high-frequency antennas there-between, the buffering sheet and each of the first high-frequency antennas are electrically connected by using one of the first extending segments;

wherein the length of an edge of the buffering sheet is different from that of an edge of each of the first high-frequency antennas, and the edge of each of the first high-frequency antennas is shorter than an edge of each of the low-frequency antennas; and a feeding unit having a first feeding segment and a second feeding segment, wherein two of the low-frequency antennas arranged in a diagonal of the antenna array are respectively and electrically connected to the adjacent first high-frequency antennas by using the first feeding segment and the second feeding segment; and a grounding member and a plurality of supporting pillars, wherein an end of each of the supporting pillars is fixed on the antenna array, and the other end of each of the supporting pillars is fixed on the grounding member, so that the antenna array is arranged apart from the grounding member.

2. The MIMO antenna device as claimed in claim 1, wherein each of the first high-frequency antennas is configured to transmit a signal in a high-frequency band, and a resonance frequency of the buffering sheet does not overlap the high-frequency band, thus two signals traveling along the two first high-frequency antennas and the buffering sheet in two opposing directions have an isolation smaller than −15 dB.

3. The MIMO antenna device as claimed in claim 2, wherein the length of the edge of the buffering sheet is less than that of the edge of each of the low-frequency antennas and is more than that of the edge of each of the first high-frequency antennas.

4. The MIMO antenna device as claimed in claim 1, wherein the low-frequency unit includes two second jumpers, any two adjacent low-frequency antennas arranged in the second longitudinal direction are electrically connected by using one of the two second jumpers, and the two second jumpers are arranged to face each other; the high-frequency unit includes two second high-frequency antennas each having a substantially square shape and two second extending segments, the length of an edge of each of the second high-frequency antennas is equal to that of the edge of each of the first high-frequency antennas; the two second high-frequency antennas are respectively arranged at two opposite sides of the buffering sheet, and the two second high-frequency antennas and the buffering sheet are arranged in the second longitudinal direction; any two adjacent low-frequency antennas arranged in the first longitudinal direction are arranged with one of the second high-frequency antennas there-between, the buffering sheet and each of the second high-frequency antennas are electrically connected by using one of the second extending segments; the feeding unit has a third feeding segment and a fourth feeding segment, two of the low-frequency antennas arranged in the other diagonal of the antenna array are respectively and electrically connected to the adjacent second high-frequency antennas by using the third feeding segment and the fourth feeding segment.

5. The MIMO antenna device as claimed in claim 4, wherein a center of the buffering sheet, the two first extending segments, and a center of each of the two first high-frequency antennas are arranged in the first longitudinal direction; the center of the buffering sheet, the two second extending segments, and a center of each of the two second high-frequency antennas are arranged in the second longitudinal direction.

6. The MIMO antenna device as claimed in claim 4, wherein two adjacent edges of each of the low-frequency antennas each has a center, and the centers of the two adjacent edges of each of the low-frequency antennas are respectively connected to the corresponding first jumper and the corresponding second jumper.

7. The MIMO antenna device as claimed in claim 4, wherein a first projecting region defined by orthogonally projecting each of the first jumpers onto the adjacent second high-frequency antenna is arranged apart from a center of the adjacent second high-frequency antenna and is arranged away from the buffering sheet; a second projecting region defined by orthogonally projecting each of the second jumpers onto the adjacent first high-frequency antenna is arranged apart from a center of the adjacent first high-frequency antenna and is arranged away from the buffering sheet.

8. The MIMO antenna device as claimed in claim 4, wherein the antenna array is a four-folded symmetrical construction with respective to a center of the buffering sheet; the low-frequency antennas are substantially in a coplanar arrangement, the buffering sheet and the high-frequency unit are substantially in a coplanar arrangement, and a height of the low-frequency unit with respective to the grounding member is more than that of the high-frequency unit.

* * * * *